US009104221B2

(12) United States Patent
Kim

(10) Patent No.: US 9,104,221 B2
(45) Date of Patent: Aug. 11, 2015

(54) POWER SUPPLY MODULE, ELECTRONIC DEVICE INCLUDING THE SAME AND POWER SUPPLY METHOD

(75) Inventor: Sung-Ha Kim, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 346 days.

(21) Appl. No.: 13/528,303

(22) Filed: Jun. 20, 2012

(65) Prior Publication Data

US 2013/0002216 A1 Jan. 3, 2013

(30) Foreign Application Priority Data

Jun. 30, 2011 (KR) ..... 10-2011-0065046

(51) Int. Cl.
*G05F 1/565* (2006.01)
*G05F 1/575* (2006.01)

(52) U.S. Cl.
CPC ..... *G05F 1/575* (2013.01); *G05F 1/565* (2013.01)

(58) Field of Classification Search
CPC ..... G05F 1/462; G05F 1/565; G05F 1/575
USPC ..... 323/273–275
See application file for complete search history.

(56) References Cited

U.S. PATENT DOCUMENTS

| | | | | |
|---|---|---|---|---|
| 6,259,237 | B1 * | 7/2001 | Fischer | 323/277 |
| 6,373,233 | B2 * | 4/2002 | Bakker et al. | 323/282 |
| 6,603,292 | B1 * | 8/2003 | Schouten et al. | 323/277 |
| 7,218,168 | B1 * | 5/2007 | Rahman | 327/540 |
| 7,728,569 | B1 * | 6/2010 | Le et al. | 323/280 |
| 7,821,242 | B2 * | 10/2010 | Takagi | 323/275 |
| 8,471,539 | B2 * | 6/2013 | Wu | 323/275 |
| 2007/0030054 | A1 * | 2/2007 | Lee et al. | 327/541 |
| 2010/0066320 | A1 | 3/2010 | Dasgupta et al. | |
| 2011/0018549 | A1 * | 1/2011 | Hashimoto | 324/537 |
| 2012/0038332 | A1 * | 2/2012 | Lin | 323/277 |
| 2012/0126760 | A1 * | 5/2012 | Vemula | 323/271 |
| 2012/0146597 | A1 * | 6/2012 | Shimizu et al. | 323/265 |
| 2012/0299564 | A1 * | 11/2012 | Howes et al. | 323/281 |
| 2013/0154593 | A1 * | 6/2013 | Chen et al. | 323/273 |
| 2013/0271100 | A1 * | 10/2013 | El-Nozahi | 323/280 |
| 2013/0285631 | A1 * | 10/2013 | Bisson et al. | 323/280 |

FOREIGN PATENT DOCUMENTS

| | | |
|---|---|---|
| KR | 1020040030242 | 4/2004 |
| KR | 1020060096398 | 9/2006 |
| KR | 1020100083871 | 7/2010 |

* cited by examiner

*Primary Examiner* — Fred E Finch, III
(74) *Attorney, Agent, or Firm* — Ellsworth IP Group PLLC

(57) ABSTRACT

A power supply module and a power supply method corresponding to an electronic device. The power supply module includes a low-dropout (LDO) voltage regulator to adjust an input signal received from a battery and output a stabilized output signal, and an external load calculation circuit to calculate an external load value at a power output node of the LDO voltage regulator and stabilize the output signal based on the external load value.

18 Claims, 11 Drawing Sheets

Decrease $C_C$ at Large $C_L$

Phase Margin=45°

Phase Margin=60°

Phase Margin=90°

POWER SUPPLY MODULE, ELECTRONIC DEVICE INCLUDING THE SAME AND POWER SUPPLY METHOD

CROSS-REFERENCE TO RELATED APPLICATIONS

This application claims priority under 35 U.S.C. §119(a) from Korean Patent Application No. 10-2011-0065046 filed on Jun. 30, 2011, the disclosure of which is hereby incorporated by reference in its entirety.

BACKGROUND

1. Field

The present general inventive concept relates to a regulator, and more particularly, to a negative feedback amplification system such as a low-dropout (LDO) voltage regulator.

2. Description of the Related Art

Low-dropout (LDO) voltage regulators are used to generate a stable voltage in devices such as cellular phones, wireless phones, pagers, personal digital assistants (PDAs), portable personal computers (PCs), camcorders and digital cameras, which are portable and can be operated by batteries. An LDO voltage regulator is characterized by an LDO voltage, i.e., a minimum difference between an unregulated input voltage, such as a voltage received from a battery or a transformer, and a regulated (or stable) output voltage. The LDO voltage regulator minimizes a dropout voltage so that portable devices can operate for a long time with a single battery voltage. Accordingly, the LDO voltage regulator alleviates a headroom condition and increases power efficiency as compared to a linear regulator with a high dropout voltage. Demand on LDO voltage regulators increases in direct proportion to demand on portable devices.

An LDO voltage regulator requires a capacitor installed at an outside portion of a chip to stabilize an output. However, since there are no standard guidelines regarding a capacitance level of an external capacitor used to stabilize an output of the LDO voltage regulator, capacitors having various values of 0.1 to 2 μF are used by different manufacturing companies. Accordingly, when LDO voltage regulators are designed, output stability (i.e., a phase margin) is compromised in order to satisfy the range of external capacitors.

SUMMARY

The present general inventive concept provides a power supply module including a low-dropout (LDO) voltage regulator and an external load calculation circuit to stabilize a signal output from the LDO voltage regulator based on an external load value at a power output node of the LDO voltage regulator.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a power supply module including a low-dropout (LDO) voltage regulator to adjust an input signal received from a battery and output a stabilized output signal, and an external load calculation circuit to calculate an external load value at a power output node of the LDO voltage regulator and stabilize the output signal based on the external load value.

The external load calculation circuit may include a discharge control block to be connected in parallel to the power output node and to discharge a predetermined current from the output signal, an output level detecting block to be connected in parallel to the power output node and to detect a voltage level of the output signal at intervals of a predetermined period of time, and a calculation block including a load calculator to obtain a voltage difference between a peak voltage and a stabilized voltage among detected voltage levels of the output signal and a duration therebetween and to calculate the external load value using the voltage difference, the duration, and the discharged predetermined current, and a controller to generate control signals to stabilize the output signal based on the external load value.

The LDO voltage regulator may include a first current controller to have an input terminal connected to the battery, a first control terminal, and a first terminal connected to the power output node, a feedback block to divide a voltage of the output signal to output a feedback signal, an operational amplifier to generate an operated signal corresponding to a difference between the feedback signal from the feedback block and a reference voltage and to output the operated signal to the first control terminal, and a stabilizing block to be connected between the first control terminal and the power output node and to stabilize the output signal.

The discharge control block may include a second current controller to have a second terminal connected to the power output node, a second control terminal receiving a discharge control signal among the control signals, and a third terminal; and a current source to be connected to the third terminal and to discharge the predetermined current to a ground terminal.

The output level detecting block may include a counter to count the predetermined period of time, and a level detector to be connected between the counter and the power output node and to detect the voltage level of the output signal at intervals of the predetermined period of time.

The control signals may include a feedback control signal to control the voltage division of the feedback block to adjust the feedback signal, a stabilizing signal to adjust a variable capacitance of the stabilizing block to stabilize the output signal; and a discharge control signal applied to the discharge control block to control the discharge of the predetermined current from the output signal.

The LDO voltage regulator, the discharge control block, the output level detecting block, and the calculation block may be implemented in separate chips, respectively, in a multi-chip package.

The LDO voltage regulator and the external load calculation circuit may be integrated into a single semiconductor substrate.

The foregoing and/or other features and utilities of the present general inventive concept may also be achieved by providing a power supply method, including outputting to a low-dropout (LDO) voltage regulator a stabilizing signal based on an external load value of a power output node of the LDO voltage regulator, and optimizing a phase margin of the LDO voltage regulator by adjusting a signal input from a battery based on the received stabilizing signal.

The operation of the outputting to a low-dropout (LDO) voltage regulator a stabilizing signal may include discharging a predetermined current from an output signal into which an LDO voltage regulator transforms an input signal received from a battery and counting a predetermined period of time and detecting a voltage level during the discharge, calculating an external load value at a power output node of the LDO voltage regulator based on a result of the detection.

The operation of the optimizing a phase margin of the LDO voltage regulator may include stabilizing the output signal based on the external load value.

The operation of the optimizing a phase margin of the LDO voltage regulator may include increasing at least one of a variable capacitor and a variable resistor within the LDO voltage regulator if the external load value is below a predetermined threshold, and decreasing the at least one of the variable capacitor and the variable resistor within the LDO voltage regulator if the external load value is above the predetermined threshold.

The operation of calculating the external load value may include obtaining a voltage difference between a peak voltage and a stabilized voltage among detected voltage levels of the output signal and a duration therebetween, and calculating the external load value using the voltage difference, the duration, and the discharged predetermined current.

The operation of stabilizing the output signal may include adjusting a variable capacitance of the LDO voltage regulator based on the external load value.

The operation of stabilizing the output signal may further include adjusting a variable resistance of a feedback loop in the LDO voltage regulator based on the external load value.

The foregoing and/or other features and utilities of the present general inventive concept may also be achieved by providing a power supply including a low-dropout (LDO) voltage regulator to optimize a phase margin thereof by adjusting a signal input from a battery, and an external load calculation circuit to output to the LDO voltage regulator a stabilizing signal based on an external load value of a power output node of the LDO voltage regulator to perform the phase margin optimization.

The LDO voltage regulator may further include a stabilizing block comprising at least one of a variable capacitor and a variable resistor to perform the phase margin optimization.

The phase margin optimization may be performed by adjusting the at least one of the variable capacitor and the variable resistor based on the stabilizing signal received from the external load calculation circuit.

The at least one of the variable capacitor and the variable resistor may be increased if the external load value is below a predetermined threshold, and the at least one of the variable capacitor and the variable resistor may be decreased if the external load value is above the predetermined threshold.

The optimal phase margin may be 60%.

BRIEF DESCRIPTION OF THE DRAWINGS

The above and other features and utilities of the present general inventive concept will become more apparent by describing in detail exemplary embodiments thereof with reference to the attached drawings in which.

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
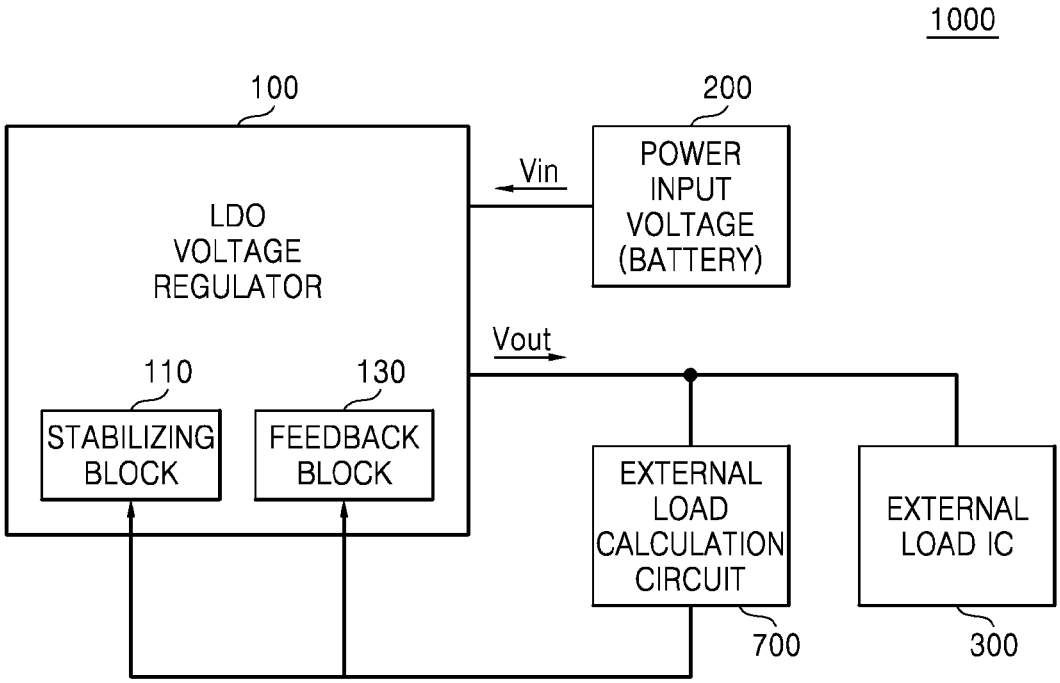
FIG. 1 is a schematic diagram of a power supply module according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. As used herein, the term "and/or" includes any and all combinations of one or more of the associated listed items and may be abbreviated as "/".

It will be understood that, although the terms first, second, etc. may be used herein to describe various elements, these elements should not be limited by these terms. These terms are only used to distinguish one element from another. For example, a first signal could be termed a second signal, and, similarly, a second signal could be termed a first signal without departing from the teachings of the disclosure.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

FIG. 1 is a schematic diagram of a power supply module 1000 according to an exemplary embodiment of the present general inventive concept. The power supply module 1000 includes an LDO voltage regulator 100, a battery 200, an external load integrated circuit (IC) 300, and an external load calculation circuit 700.

The LDO voltage regulator 100 adjusts an input signal Vin received from the battery 200 to an output signal Vout corresponding to a reference voltage and provides the output signal Vout to an electronic device. The external load IC 300 is connected to an output terminal of the LDO voltage regulator 100 and may include an external capacitor or resistor.

The external load calculation circuit 700 is connected in parallel between the output terminal of the LDO voltage regulator 100 and the external load IC 300. The external load calculation circuit 700 calculates an external load value and controls the output signal Vout based on the external load value in order to stabilize the output of the LDO voltage regulator 100.

Figure 2:
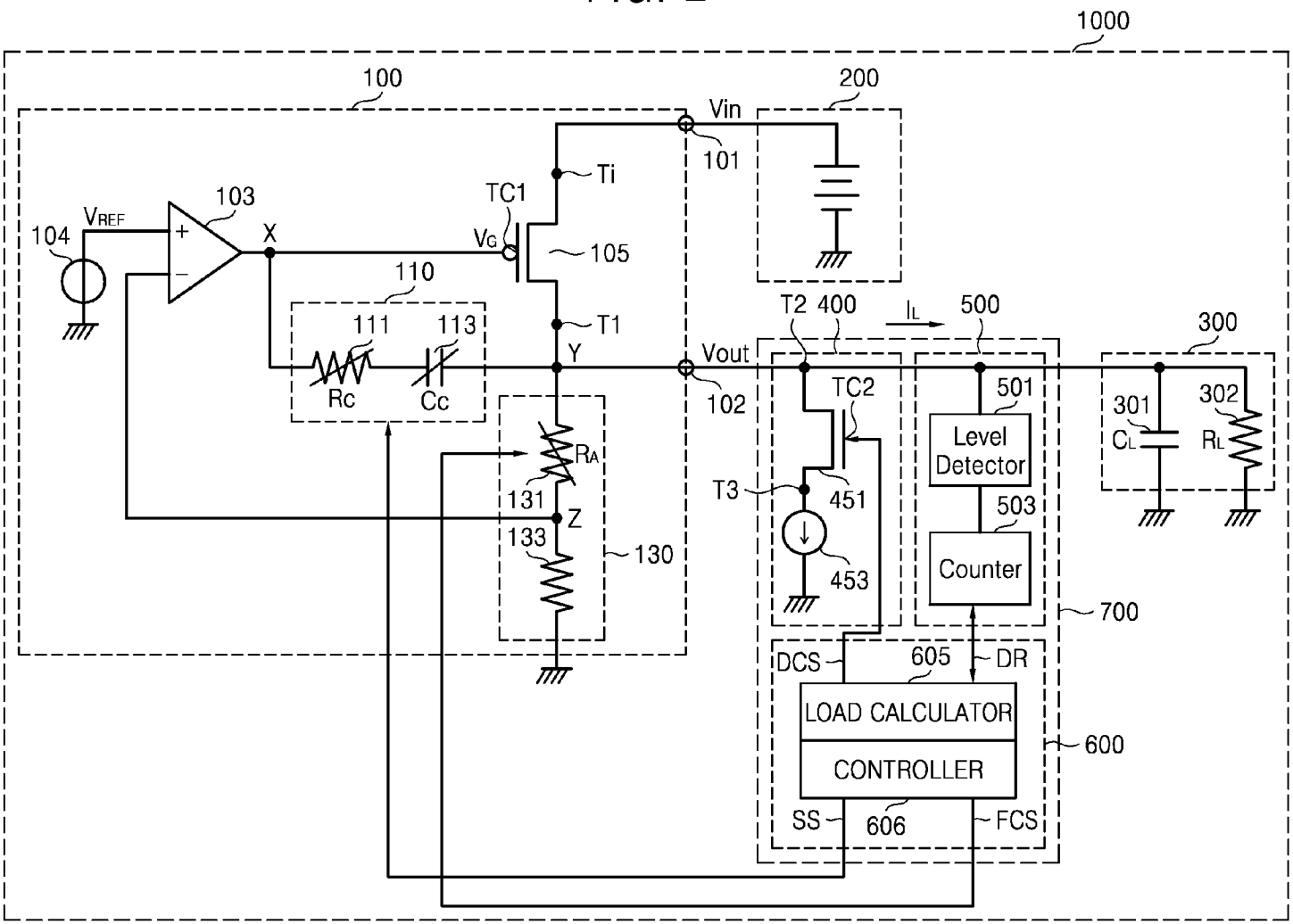
FIG. 2 is a detailed block diagram of the power supply module illustrated in FIG. 1.

FIG. 2 is a detailed block diagram of the power supply module 1000 illustrated in FIG. 1. The LDO voltage regulator 100 includes a first current controller 105 having an input terminal T1 connected to an input node 101, a first control terminal TC1 connected to a power output node Y, and a first terminal T1 connected to a Vout 102, an operational amplifier 103 that generates a gate signal $V_G$ applied to the first control terminal of the first current controller 105, a stabilizing block 110 connected between an output node X of the operational amplifier 103 and the power output node Y, a feedback block 130 connected to an inverting input terminal (−) of the operational amplifier 103 and the power output node Y to perform output level control, and a reference voltage supply 104 connected to a non-inverting input terminal (+) of the operational amplifier 103. The first current controller 105 may be implemented as a P-type metal oxide semiconductor (PMOS) transistor or an N-type metal oxide semiconductor (NMOS) transistor, but is not limited thereto. For example, the first current controller 105 may also be implemented by a PNP or NPN bipolar transistor.

Figure 8:
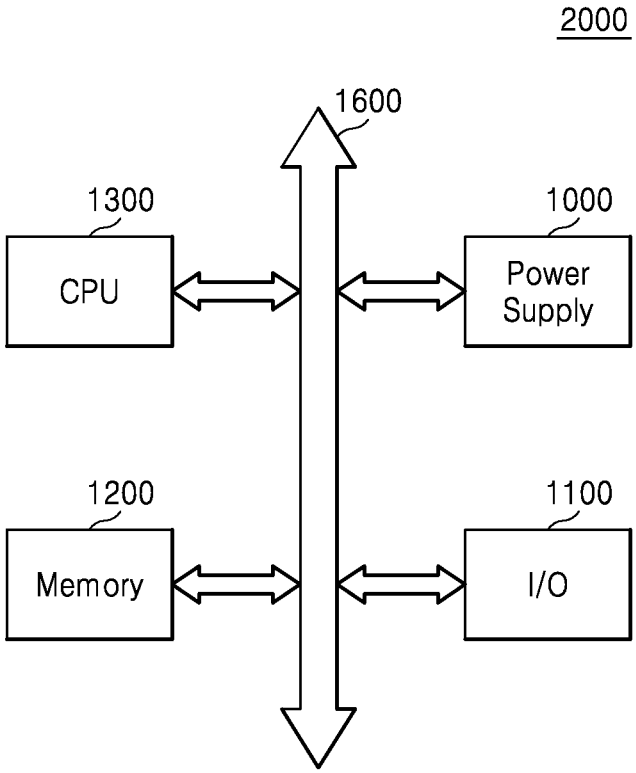
FIG. 8 is a diagram of an electronic device including a power supply module according to an exemplary embodiment of the present general inventive concept.

The LDO voltage regulator 100 receives an unregulated input voltage Vin through the input node 101 connected to the battery 200 and generates a regulated output signal Vout at the power output node Y connected to the external load IC 300, thereby accelerating an operation of an electronic device, such as an electronic device 2000, as illustrated in FIG. 8.

The operational amplifier 103 has the non-inverting input terminal (+) connected to the reference voltage supply 104 and the inverting input terminal (−) connected to a voltage dividing node Z. The reference voltage supply 104 provides a stable reference voltage $V_{REF}$ to the op amp 103, as is known in the art.

The stabilizing block 110 is connected between the output port X of the operational amplifier 103 and the power output node Y and provides the stabilized output signal Vout to the power output node Y using a variable resistor Rc 111 and/or a bypass capacitor (or a high-pass filter) Cc 113 having variable capacitance. The stabilizing block 110 stabilizes the output signal Vout in response to a stabilizing signal SS received from the external load calculation circuit 700.

In other words, the stabilizing block 110 is connected between the output node X of the operational amplifier 103 and the power output node Y and includes at least one of the variable resistor 111 and the variable capacitor 113. At this time, the stabilizing block 110 stabilizes the output signal Vout in response to the stabilizing signal SS received from the external load calculation circuit 700.

The feedback block 130 acts as a voltage divider and includes a variable resistor 131 and a fixed resistor 133. The feedback block 130 divides the voltage of the output signal Vout and applies a division result as a feedback signal to the inverting input terminal (−) of the operational amplifier 103. At this time, the variable resistor 131 adjusts a resistance value in response to a feedback control signal FCS received from the external load calculation circuit 700, so that the gate signal $V_G$ output from the operational amplifier 103 is adjusted.

The external load calculation circuit 700 includes a discharge control block 400, an output level detecting block 500, and a calculation block 600.

The discharge control block 400 discharges predetermined current at a power-up stage of the LDO voltage regulator 100 until the output signal Vout is stabilized every time when an external capacitor 301 of the external load IC 300 changes. The discharge is controlled by a discharge control signal DCS received from the external load calculation circuit 700. The external load IC 300 may also include a resistor 302 connected in parallel with the external capacitor 301.

In other words, the discharge control block 400 discharges a predetermined current $I_L$ until the output signal Vout is stabilized in the power-up stage of the LDO voltage regulator 100 whenever the external load value of the external load IC 300 changes. The discharge control block 400 includes a second current controller 451 and a current source 453.

The second current controller 451 has a second terminal T2 connected in parallel with the feedback block 130 of the LDO voltage regulator 100 through the power output node Y of the LDO voltage regulator 100, a second control terminal TC2, and a third terminal T3. The second control terminal TC2 is connected to a third interface 603 of the calculation block 600 to control the current discharge of the output signal Vout. To assist the current discharge, the current source 453 is connected between the third terminal and a ground terminal. The second current controller 451 may be implemented by a PMOS transistor or an NMOS transistor in the current embodiments, but is not limited thereto. For example, the second current controller 451 may also be implemented by a PNP or NPN bipolar transistor.

The output level detecting block 500 detects a duration Δt between a peak voltage and a stabilized voltage of the output signal Vout and a voltage difference ΔV in the duration Δt at the power-up stage of the LDO voltage regulator 100 every time when the external capacitor 301 of the external load IC 300 changes and transmits a detection result DR including the duration Δt and the voltage difference ΔV to the calculation block 600.

The output level detecting block 500 includes a level detector 501 and a counter 503.

The counter 503 counts a predetermined period of time and the level detector 501 measures a voltage level of the output signal Vout at intervals of the predetermined period of time. The level detector 501 measures a peak voltage level when the second current controller 451 is turned on and a stabilized voltage level when the second current controller 451 is turned off and provides the measured voltage levels to the calculation block 600. The counter 503 counts a duration Δt between the turning on and the turning off of the second current controller 451 and provides the duration Δt to the calculation block 600.

The calculation block 600 calculates an external load value based on the detection result DR and includes a load calculator 605, a controller 606 and first through fourth interfaces 601 through 604. The calculation block 600 calculates the external load value based on the duration Δt and the voltage difference ΔV so that the output signal Vout is controlled based on the detection result DR. As a result, the output signal Vout of the LDO voltage regulator 100 is stabilized.

The load calculator 605 generates a discharge control signal DCS to control the discharge of the predetermined current $I_L$ from the output signal Vout and applies the discharge control signal DCS to the discharge control block 400 via the third interface 603. The load calculator 605 also detects a voltage difference ΔV and the duration Δt from the detection result DR received from the output level detecting block 500 via the fourth interface 604. The load calculator 605 calculates the external load value using the current $I_L$ predetermined to be discharged, the voltage difference ΔV, and the duration Δt.

The controller 606 generates a control signal to stabilize the output of the LDO voltage regulator 100 based on the external load value.

In detail, the controller 606 generates and sends the stabilizing signal SS from the first interface 601 to control the stabilizing block 110 of the LDO voltage regulator 100, and also generates and sends the feedback control signal FCS from the second interface 602 to control the feedback block 130 of the LDO voltage regulator 100.

Figure 3:
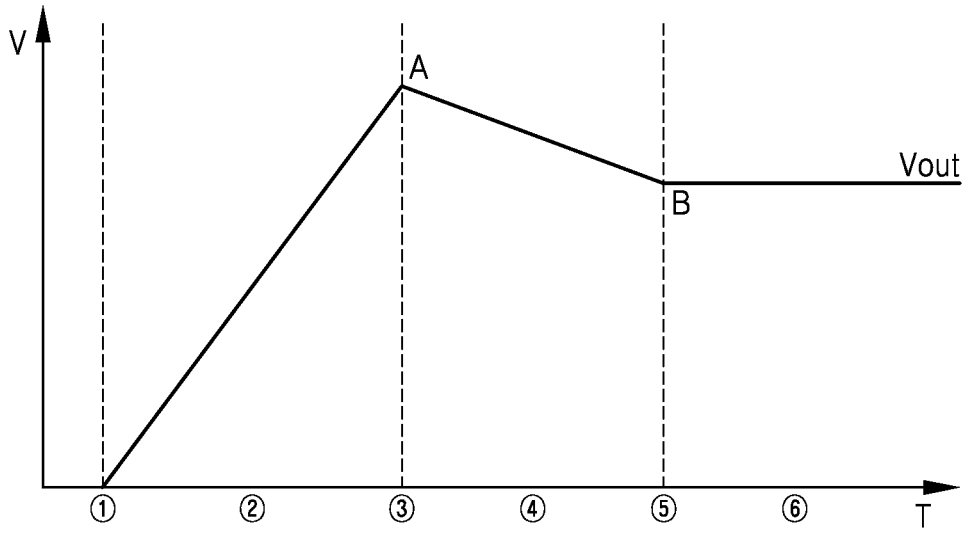
FIG. 3 is a timing chart illustrating an operation of the power supply module illustrated in FIG. 2.

FIG. 3 is a timing chart illustrating an operation of the power supply module 1000 illustrated in FIG. 2. Referring to FIGS. 2 and 3, the input voltage Vin from the battery 200 starts to be applied to the LDO voltage regulator 100 (①). Upon receiving the input voltage Vin, the reference voltage $V_{REF}$ is applied to the non-inverting input terminal (+) of the operational amplifier 103 and a signal from the feedback block 130 is applied to the inverting input terminal (−) of the operational amplifier 103, The gate signal $V_G$ resulting from the operational amplifier 103 performing an operation on the reference voltage $V_{REF}$ and the signal received from the feedback block 130, is applied to the stabilizing block 110 and the control terminal of the first current controller 105, so that the voltage of the output signal Vout gradually increases (②).

The voltage level of the output signal Vout increases up to a peak A (③) and then gradually decreases due to the operations of the feedback block 130 and the discharge control block 400. The output level detecting block 500 detects a duration Δt between the peak A and a stabilized level B and the voltage difference ΔV therebetween (④). When the output signal Vout is stabilized and constant (⑤), the calculation block 600 calculates an external load value $C_L$ based on the discharged predetermined current $I_L$, the voltage difference ΔV (=V(A)−V(B)), and the duration Δt (=t(B)−t(A)) (⑥).

The discharged predetermined current $I_L$ is obtained using Equation 1:

$$I_L = C_L \frac{dVout}{dt}. \quad \text{(Equation 1)}$$

To obtain an external capacitance, i.e., the external load value $C_L$, Equation 1 is rewritten as Equation 2:

$$C_L = I_L \frac{\Delta t}{\Delta V} = I_L \frac{t(B-A)}{V(A-B)}. \quad \text{(Equation 2)}$$

In other words, the calculation block 600 calculates the external load value $C_L$ using Equation 2 based on the discharged predetermined current $I_L$, the voltage difference ΔV (=V(A)−V(B)), and the duration Δt (=t(B)−t(A)).

The calculation block 600 outputs the feedback control signal FCS to the feedback block 130 to adjust a variable resistance $R_A$ of the variable resistor 131, so that the output signal Vout of the LDO voltage regulator 100 is adjusted based on the external load value $C_L$. When the adjusted variable resistance $R_A$ is used, the gate signal $V_G$ of the operational amplifier 103 is expressed as $$V_{REF} \cdot \left(1 + \frac{R_A}{R_B}\right).$$

Therefore, the output signal Vout is adjusted according to the gate signal $V_G$ corresponding to the variable resistance $R_A$.

The calculation block 600 outputs the stabilizing signal SS generated based on the external load value $C_L$ to the stabilizing block 110 to adjust a variable capacitance $C_C$ and a variable resistance $R_C$. Adjustment of the variable capacitance $C_C$ will be described in detail with reference to FIGS. 4A and 4B.

Figure 4A:
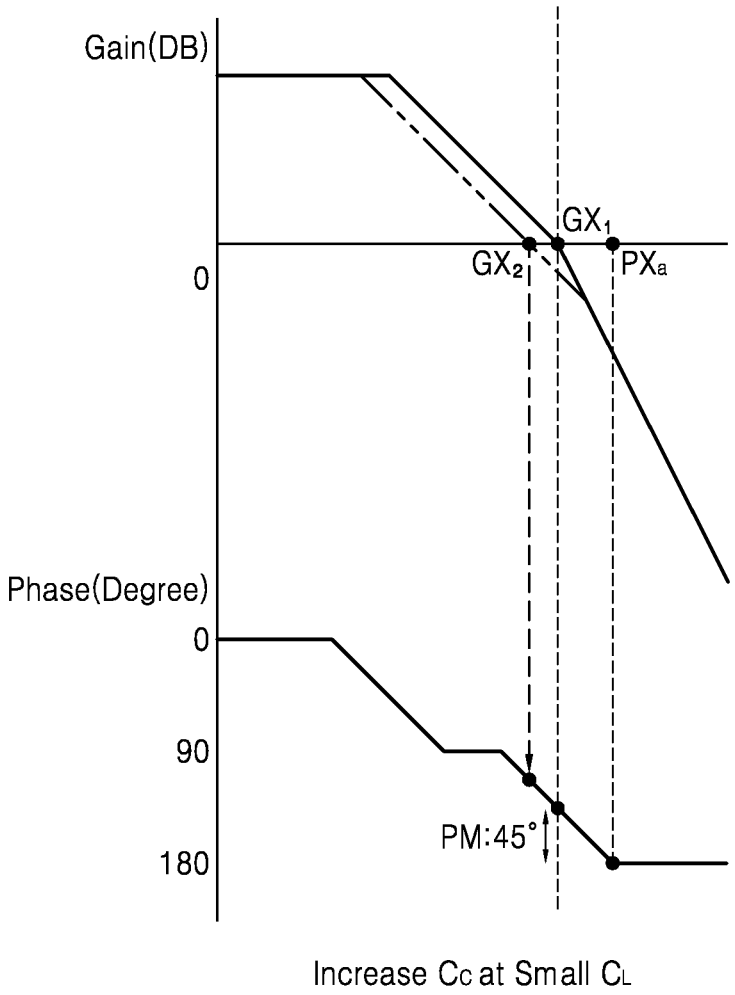
FIGS. 4A and 4B are Bode plots corresponding to the power supply module illustrated in FIG. 2.
Figure 4B:
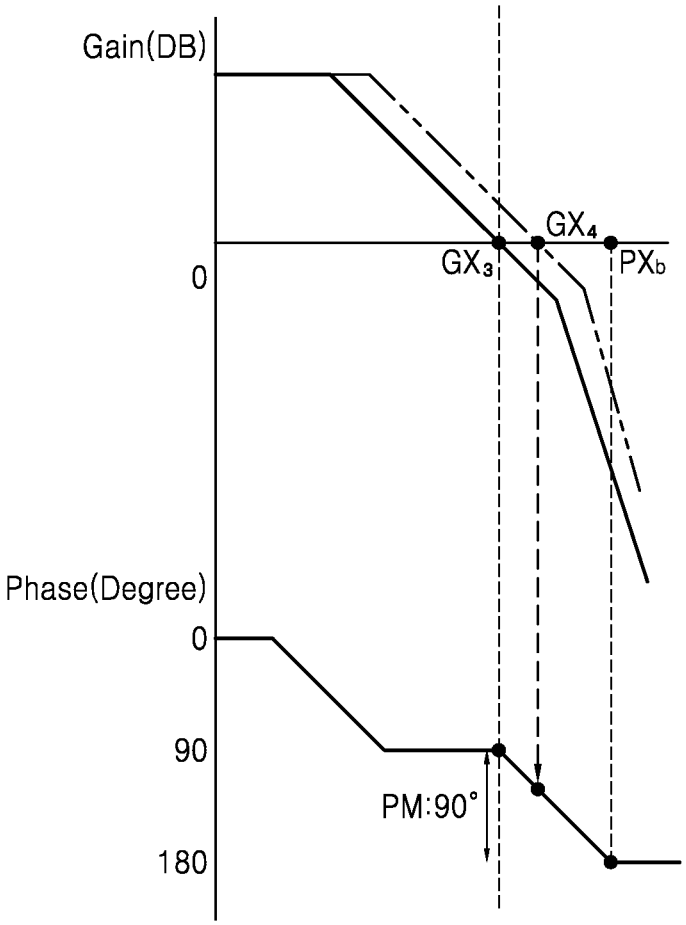
Figure 5A:
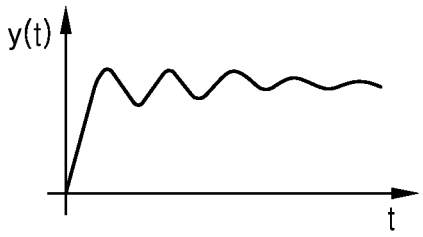
FIGS. 5A through 5C are graphs illustrating frequency responses of a low dropout (LDO) voltage regulator in order to explain a phase margin.
Figure 5B:
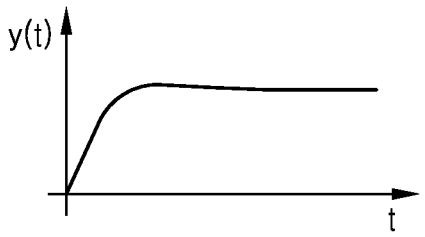
Figure 5C:
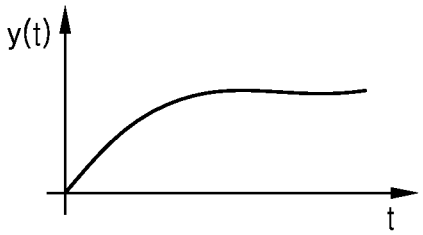

FIGS. 4A and 4B are Bode plots corresponding to the power supply module 1000 illustrated in FIG. 2. FIGS. 5A through 5C are graphs illustrating frequency responses of the LDO voltage regulator 100 in order to illustrate various phase margins.

A conventional LDO voltage regulator with a domain pole of $$\frac{1}{R_L C_L}$$

has a Bode plot expressed by the solid line in FIG. 4A when the external load value $C_L$ is small and a Bode plot expressed by the solid line in FIG. 4B when the external load value $C_L$ is large.

In order to accomplish system stability, the gain must drop to 0 dB before the phase is over 180 degrees. In other words, when a phase crossing PX moves farther away from a gain crossing GX, the output of the LDO voltage regulator is more stable. That is, as the phase is smaller at the gain crossing GX, a system is more stable. The system stability may be measured by a phase margin. The phase margin is defined by PM=180°+∠βH(ω=ω1) where ω1 is a gain crossing frequency.

Referring to FIG. 4A illustrating the Bode plot when external load value $C_L$ is small, the phase is −135 degrees at a gain crossing $GX_1$, and therefore, the phase margin PM from $PX_a$ is 180+(−135)=45 degrees. Referring to FIG. 4B illustrating the Bode plot when external load value $C_L$ is large, the phase is −90 degrees at a gain crossing $GX_3$, and therefore, the phase margin PM from $PX_b$ is 180+(−90)=90 degrees.

The closed-loop frequency responses of the LDO voltage regulator obtained when the phase margin PM is 45, 60 and 90 degrees, respectively, can be compared with one another. Referring to FIG. 5A, when the phase margin PM is 45 degrees, the phase is −135 degrees at the gain crossing frequency and the gain at the gain crossing GX is 0, and therefore, the frequency response has a peak of 30% at the gain crossing GX. Referring to FIG. 5B, when the phase margin PM is 60 degrees, the frequency response is a peak of 1/β that is ignorable at the gain crossing GX. In other words, a swing of a step response is less at the phase margin PM of 60 degrees than at the phase margin PM of 45 degrees, the frequency response is settled more quickly. Referring to FIG. 5C, when the phase margin PM is 90 degrees greater than 60 degrees, a closed-loop frequency response system is more stable, but a time response is slower than when the phase margin PM is 60 degrees. Consequently, as PX moves farther away from GX, the output of the LDO voltage regulator is more stable, but the phase margin PM of 60 degrees is considered optimal.

Referring to FIGS. 4A through 5C, when a variable capacitance $C_C$ of the stabilizing block 110 based on an external load value is used, a dominant pole is $$\frac{1}{R_L(C_L + (1 + A_V)C_C)}.$$

Here, $C_L$ is the capacitance of the external load, $R_L$ is a load resistance of the external load, $A_V$ is the gain of the operational amplifier 103 and $C_C$ is the variable capacitance.

Referring to FIG. 4A, when the external capacitance $C_L$ is small, the optimal phase margin PM of 60 degrees can be secured by shifting the gain crossing GX toward an origin by increasing the variable capacitance $C_C$. In other words, when the phase margin PM is 45 degrees at the small external capacitance $C_L$ as illustrated in FIG. 5A, the gain crossing is shifted from $GX_1$ to $GX_2$ by increasing the variable capacitance $C_C$ to make the phase margin PM 60 degrees, so that the swing of the frequency response is reduced and the system is made more stable.

Referring to FIG. 4B, when the external capacitance $C_L$ is large, the optimal phase margin PM of 60 degrees can be secured by shifting the gain crossing GX away from the origin by decreasing the variable capacitance $C_C$. In other words, when the phase margin PM is 90 degrees at the large external capacitance $C_L$ as illustrated in FIG. 5B, the gain crossing is shifted from $GX_3$ to $GX_4$ by decreasing the variable capacitance $C_C$ to make the phase margin PM 60 degrees, so that the time response becomes faster.

The above operations may be performed according to a Miller compensation technique. Accordingly, even though external loads may differ depending on various manufacturing companies, an external load value is calculated in the present general inventive concept, and therefore, a frequency at which an output capacitance is optimal can be made a dominant pole. In other words, the phase margin is improved based the output capacitance, so that system stability is guaranteed. In addition, stability can be secured in a power supply module with various external loads using a component, so that development costs can be reduced.

Figure 6:
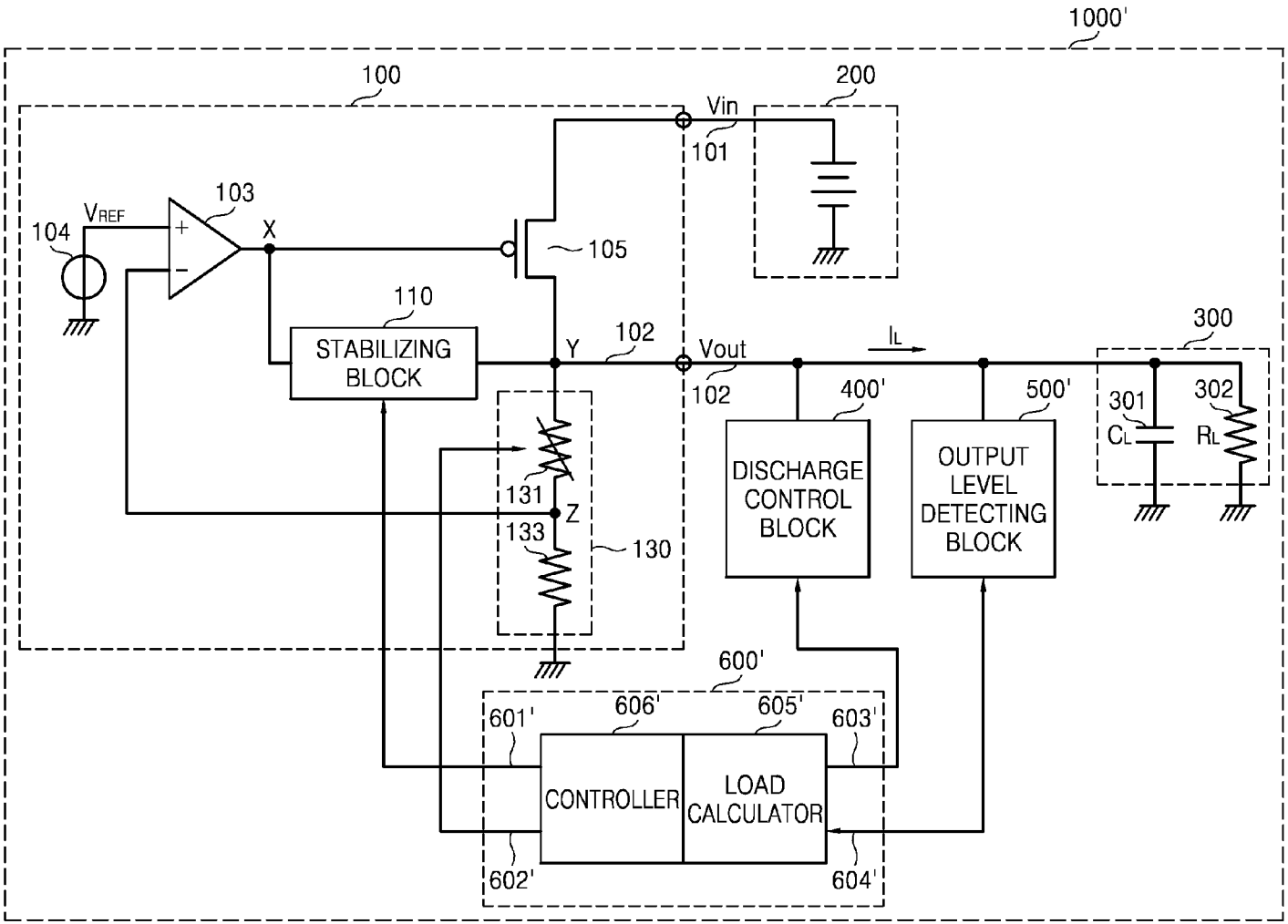
FIG. 6 is a block diagram of a power supply module according to another exemplary embodiment of the present general inventive concept.

FIG. 6 is a block diagram of a power supply module 1000' according to another exemplary embodiment of the present general inventive concept. The power supply module 1000' includes the LDO voltage regulator 100, the battery 200, the external load IC 300, a discharge control block 400', an output level detecting block 500', and a calculation block 600'. Herein, differences between the power supply module 1000 illustrated in FIG. 2 and the power supply module 1000' illustrated in FIG. 6 will be described. The LDO voltage regulator 100 has the same structure as illustrated in FIGS. 1 and 2, but the discharge control block 400', the output level detecting block 500' and the calculation block 600' provided to control the output signal Vout of the LDO voltage regulator 100 are implemented separately instead of being implemented in a single IC.

The LDO voltage regulator 100 and the external load calculation circuit 700 are illustrated to be components that are separate from each other in FIGS. 1, 2 and 6, but they may be integrated into a single semiconductor substrate and thus implemented in a single device or may be implemented in separate chips, respectively, in a multi-chip package.

Figure 7:
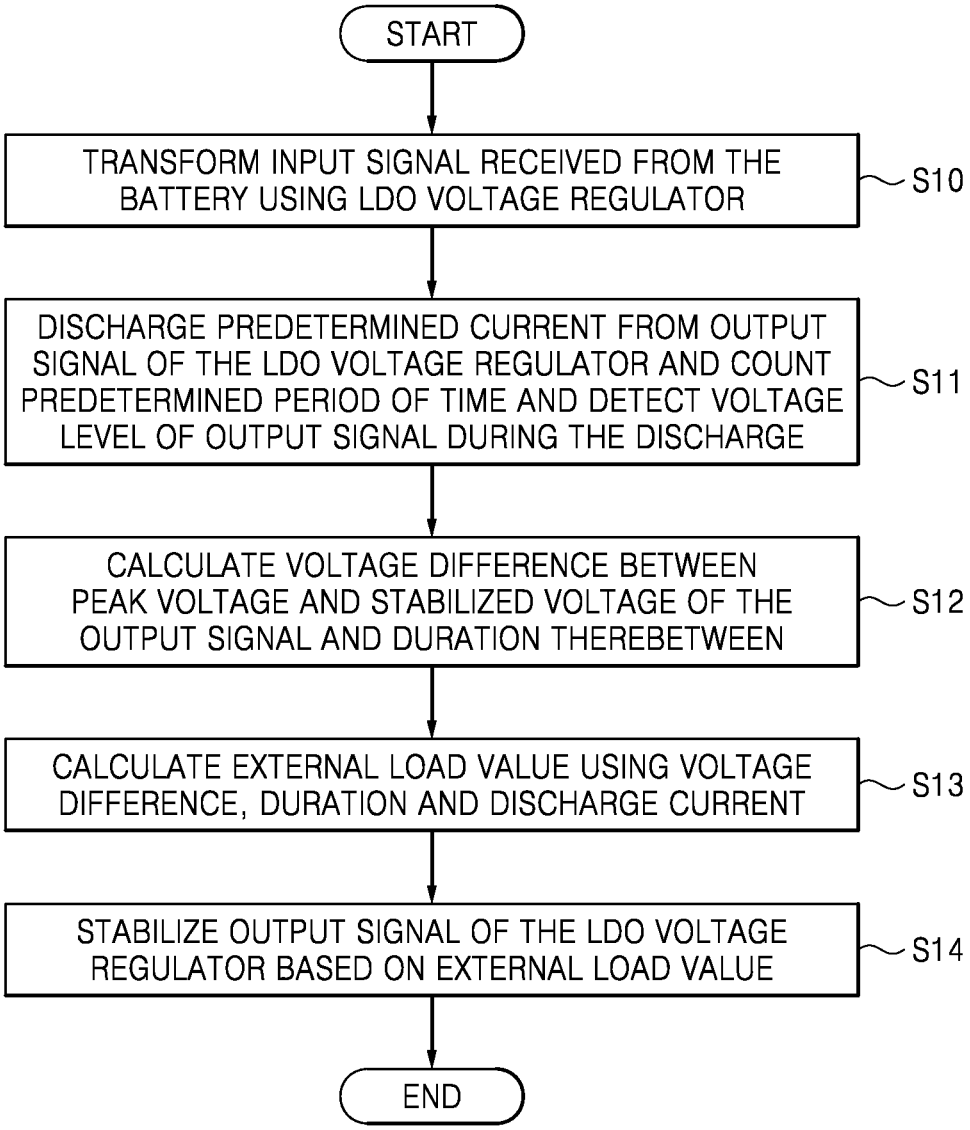
FIG. 7 is a flowchart of a power supply method according to an exemplary embodiment of the present general inventive concept.

FIG. 7 is a flowchart of a power supply method according to an exemplary embodiment of the present general inventive concept. Referring to FIGS. 1 and 7, a power supply module 1000 includes an LDO voltage regulator 100 that receives an input signal from a battery 200 and transforms the input signal to be suitable to an electronic device 2000 (as illustrated in FIG. 8), in operation S10. The power supply module 1000 discharges a predetermined current from an output signal of the LDO voltage regulator 100 and counts a predetermined period of time and detects a voltage level of the output signal during the discharge in operation S11.

A peak voltage and a stabilized voltage are detected from the detected voltage levels of the output signal and a voltage difference between the peak voltage and the stabilized voltage and a duration therebetween are calculated in operation S12. An external load value is calculated using the voltage difference, the duration, and the discharged predetermined current in operation S13.

The output signal of the LDO voltage regulator 100 is stabilized based on the external load value in operation S14. At this time, a variable capacitance of the LDO voltage regulator 100 is adjusted according to the external load value to stabilize the output signal of the LDO voltage regulator 100. In addition, a variable resistance of a feedback loop in the LDO voltage regulator 100 is adjusted according to the external load value to stabilize the output signal of the LDO voltage regulator 100.

FIG. 8 is a diagram of an electronic device 2000 including the power supply module 1000 according to an exemplary embodiment of the present general inventive concept. Referring to FIG. 8, the electronic device 2000 includes the power supply module 1000, a central processing unit (CPU) 1300, a memory device 1200, an input/output (I/O) interface unit 1100, and a bus 1600.

The CPU 1300 controls data communication among the power supply module 1000, the memory device 1200 and the I/O interface unit 110 via the bus 1600.

The memory device 1200 may be implemented by a non-volatile memory device, but is not limited thereto. The non-volatile memory device may include a plurality of non-volatile memory cells.

As described above, according to exemplary embodiments of the present general inventive concept, a power supply module calculates an external load value and adjusts an output signal at a power-up stage, thereby providing stable electric power in response to a change in an external load. In addition, stability is maximized with respect to any type of power supply module, including a power supply module having various output loads using a single component, so that development costs can be reduced.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A power supply module to be used with an electronic device, the power supply module comprising:

a low-dropout (LDO) voltage regulator to adjust an input signal received from a battery and output a stabilized output signal; and an external load calculation circuit to calculate an external load value at a power output node of the LDO voltage regulator and stabilize the output signal based on the external load value, wherein the external load calculation circuit comprises:

a discharge control block to be connected in parallel to the power output node and to discharge a predetermined current from the output signal;

an output level detecting block to be connected in parallel to the power output node and to detect a voltage level of the output signal at intervals of a predetermined period of time;

a calculation block comprising a load calculator to obtain a voltage difference between a peak voltage and a stabilized voltage among detected voltage levels of the output signal and a duration therebetween and to calculate the external load value using the voltage difference, the duration, and the discharged predetermined current; and a controller to generate control signals to stabilize the output signal based on the external load value.

2. The power supply module of claim 1, wherein the LDO voltage regulator comprises:

a first current controller to have an input terminal connected to the battery, a first control terminal, and a first terminal connected to the power output node;

a feedback block to divide a voltage of the output signal to output a feedback signal;

an operational amplifier to generate an operated signal corresponding to a difference between the feedback signal from the feedback block and a reference voltage and to output the operated signal to the first control terminal; and a stabilizing block to be connected between the first control terminal and the power output node and to stabilize the output signal.

3. The power supply module of claim 2, wherein the control signals comprise:

a feedback control signal to control the voltage division of the feedback block to adjust the feedback signal;

a stabilizing signal to adjust a variable capacitance of the stabilizing block to stabilize the output signal; and a discharge control signal applied to the discharge control block to control the discharge of the predetermined current from the output signal.

4. The power supply module of claim 1, wherein the discharge control block comprises:

a second current controller to have a second terminal connected to the power output node, a second control terminal receiving a discharge control signal among the control signals, and a third terminal; and a current source to be connected to the third terminal and to discharge the predetermined current to a ground terminal.

5. The power supply module of claim 1, wherein the output level detecting block comprises:

a counter to count the predetermined period of time; and a level detector to be connected between the counter and the power output node and to detect the voltage level of the output signal at intervals of the predetermined period of time.

6. The power supply module of claim 1, wherein the LDO voltage regulator, the discharge control block, the output level detecting block, and the calculation block are implemented in separate chips, respectively, in a multi-chip package.

7. The power supply module of claim 1, wherein the LDO voltage regulator and the external load calculation circuit are integrated into a single semiconductor substrate.

8. A power supply method, comprising:

outputting to a low-dropout (LDO) voltage regulator a stabilizing signal based on an external load value of a power output node of the LDO voltage regulator; and optimizing a phase margin of the LDO voltage regulator by adjusting a signal input from a battery based on the received stabilizing signal, wherein outputting the stabilizing signal to the LDO voltage regulator comprises:

discharging a predetermined current from an output signal into which the LDO voltage regulator transforms the input signal received from the battery and counting a predetermined period of time and detecting a voltage level during the discharge; and calculating an external load value at a power output node of the LDO voltage regulator based on a result of the detection.

9. The power supply method of claim 8, wherein the optimizing the phase margin of the LDO voltage regulator comprises: stabilizing the output signal based on the external load value.

10. The power supply method of claim 8, wherein the operation of stabilizing the output signal comprises adjusting a variable capacitance of the LDO voltage regulator based on the external load value.

11. The power supply method of claim 10, wherein the operation of stabilizing the output signal further comprises adjusting a variable resistance of a feedback loop in the LDO voltage regulator based on the external load value.

12. The power supply method of claim 8, wherein the optimizing of the phase margin of the LDO voltage regulator comprises:

Increasing a value of at least one of a variable capacitor and a variable resistor within the LDO voltage regulator if the external load value is below a predetermined threshold; and decreasing a value of the at least one of the variable capacitor and the variable resistor within the LDO voltage regulator if the external load value is above the predetermined threshold.

13. The power supply method of claim 8, wherein the operation of calculating the external load value comprises:

obtaining a voltage difference between a peak voltage and a stabilized voltage among detected voltage levels of the output signal and a duration therebetween; and calculating the external load value using the voltage difference, the duration and the discharged predetermined current.

14. A power supply module, comprising:

a low-dropout (LDO) voltage regulator to optimize a phase margin thereof by adjusting a signal input from a battery; and an external load calculation circuit to output to the LDO voltage regulator a stabilizing signal based on an external load value of a power output node of the LDO voltage regulator to perform the phase margin optimization, wherein the external load calculation circuit comprises:

a discharge controller to discharge a predetermined current from an output signal into which the LDO voltage regulator transforms the signal input from the battery;

an output level detector to count a predetermined period of time and detect a voltage level during the discharge; and a calculation unit to calculate an external load value at a power output node of the LDO voltage regulator based on a result of the detection.

15. The power supply module of claim 14, wherein the LDO voltage regulator further comprises:

a stabilizing block comprising at least one of a variable capacitor and a variable resistor to perform the phase margin optimization.

16. The power supply module of claim 15, wherein the phase margin optimization is performed by adjusting the at least one of the variable capacitor and the variable resistor based on the stabilizing signal received from the external load calculation circuit.

17. The power supply module of claim 15, wherein:

the value of at least one of the variable capacitor and the variable resistor is increased if the external load value is below a predetermined threshold; and the value of at least one of the variable capacitor and the variable resistor is decreased if the external load value is above the predetermined threshold.

18. The power supply module of claim 14, wherein the optimal phase margin is 60°.

* * * * *